US006656325B1

(12) United States Patent
Laapotti

(10) Patent No.: US 6,656,325 B1
(45) Date of Patent: Dec. 2, 2003

(54) MACHINE FOR MANUFACTURING PAPER OR BOARD

(75) Inventor: Jorma Tapio Laapotti, Palokka (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/712,988

(22) Filed: Nov. 15, 2000

Related U.S. Application Data

(63) Continuation of application No. PCT/SE99/00768, filed on May 17, 1999.

(51) Int. Cl.[7] ..... D21F 3/00
(52) U.S. Cl. ..... 162/360.2; 162/363
(58) Field of Search ..... 162/205–207, 162/367–369, 372–374, 358.1, 358.2, 358.3, 358.4, 358.5, 360.2, 361, 363

(56) References Cited

U.S. PATENT DOCUMENTS

| | | | | | |
|---|---|---|---|---|---|
| 2,911,040 | A | * | 11/1959 | Hornbostel | 162/305 |
| 4,113,557 | A | * | 9/1978 | Kankaanpaa | 162/301 |
| 4,192,713 | A | * | 3/1980 | Valkama | 162/358 |
| 4,236,962 | A | * | 12/1980 | Kankaanpaa | 162/204 |
| 4,483,745 | A | | 11/1984 | Wicks et al. | |
| 4,526,655 | A | * | 7/1985 | Karvinen et al. | 162/360.1 |
| 4,561,939 | A | | 12/1985 | Justus | |
| 4,586,984 | A | * | 5/1986 | Laapotti | 162/360.1 |
| 4,921,575 | A | * | 5/1990 | Page | 162/306 |
| 4,931,143 | A | * | 6/1990 | Karvinen et al. | 162/360.1 |
| 4,976,821 | A | * | 12/1990 | Laapotti | 162/360.1 |
| 4,988,410 | A | * | 1/1991 | Meinecke et al. | 162/360.1 |
| 5,023,985 | A | * | 6/1991 | Salo et al. | 29/132 |
| 5,389,205 | A | | 2/1995 | Pajula et al. | |
| 5,662,778 | A | * | 9/1997 | Laapotti | 162/360.2 |
| 5,762,761 | A | * | 6/1998 | Kivimaa et al. | 162/360.2 |
| 5,868,904 | A | * | 2/1999 | Laapotti | 162/360.3 |
| 5,888,354 | A | * | 3/1999 | Laapotti | 162/359.1 |
| 5,908,536 | A | * | 6/1999 | Kaasalainen et al. | 162/205 |
| 5,951,821 | A | * | 9/1999 | Laapotti | 162/205 |
| 6,103,066 | A | * | 8/2000 | Laapotti | 162/193 |

FOREIGN PATENT DOCUMENTS

| | | | | |
|---|---|---|---|---|
| DE | 297 01 948 U1 | | 5/1997 | |
| DE | 19724911 | * | 12/1998 | D21F/3/02 |
| EP | 0276203 | * | 7/1988 | D21F/3/04 |
| EP | 0 705 937 A1 | | 4/1996 | |
| EP | 0 803 605 A2 | | 10/1997 | |
| GB | 1220126 | * | 1/1971 | |

* cited by examiner

*Primary Examiner*—Steven P. Griffin
*Assistant Examiner*—Carlos Lopez
(74) *Attorney, Agent, or Firm*—Alston & Bird LLP

(57) ABSTRACT

A paper or board machine having a double-felted first press nip and a double-clothed second press nip. According to the invention the first press nip has a suction roll with suction zone, the downstream end of which is situated downstream of the press nip, the top felt being separated from the bottom felt at a point before the downstream end of the suction zone. The bottom felt of the first press nip carries the web to the second press which has a top felt which carries the web from the bottom felt of the first press nip to the second press nip, which is an extended press nip. A pickup suction roll is arranged in the top felt loop of the second press for transfer of the web from the bottom felt of the first press to the top felt of the second press. The latter bottom felt leaves the suction roll at the downstream end of the suction zone and is provided in its loop with suction boxes situated at a point before the transfer of the web to the top felt of the second press. Heat-supply devices are arranged outside the two top felts at points where one side of the web is exposed and the other side adheres to the top felts.

20 Claims, 5 Drawing Sheets

16
15
54
9
23
22
54
10
1
16
12
23
20
32
33
W
18
16
24
25
23
34
35
7
4
5
19
14
11
17
14
40
27
21
27
W
5
3
2
13
27
26
8
14
54
26b 16
15
54
9
23
22
54
10
1
16
12
23
20
32
33
W
18
16
24
25
23
34
35
7
4
5
19
14
11
17
14
40
27
21
28
29
27
W
5
3
2
13
26
8
27
26a
14
54
54

1
W
4
5
5
2
15
16
16
18
19
14
12
11
17
14
13
14
54
9
22
23
23
24
25
40
27
20
21
27
26
26b
27
54
10
23
23
34
35
7
32
33
3
8
W

1
W
4
5
5
2
15
16
16
18
19
14
12
11
17
14
13
14
54
9
22
23
23
24
25
40
27
20
21
28
29
27
26
26a
27
54
10
23
23
34
35
7
32
33
3
8
W 14
13
54
9
27
10
26
26b
32
33
7
1
W
18
11
17
14
27
21
8
4
5
19
16
16
40
24
25
23
38
39
37
3
W
5
12
15
20
22
36
2
37
16
54
23
54

14
13
54
9
27
54
10
26
26a
32
1
14
33
W
18
11
17
14
27
21
27
34
35
7
4
5
19
16
16
40
24
25
30
31
23
W
5
12
15
20
3
22
8
2
54
16
23
54

1
2
3
4
5
7
8
9
10
11
12
13
14
15
16
17
18
19
20
21
22
23
24
25
26
26b
27
32
33
36
37
38
39
40
54
W 1
2
3
4
5
7
8
9
10
11
12
13
14
15
16
17
18
19
20
21
22
23
24
25
26
26a
27
30
31
32
33
34
35
40
54
W

MACHINE FOR MANUFACTURING PAPER OR BOARD

This application is a continuation of International Application No. PCT/SE99/00768, filed May 7, 1999, currently pending, which claims the benefit of Swedish Application No. 9801741-1, filed May 15, 1998.

The present invention relates to a machine for manufacturing a continuous web of paper or board, comprising a wet section, a press section and a drying section, said wet section including a forming fabric, and said press section comprising a first press including a first press member, a second press member, said press members forming a first press nip with each other, a first press felt running in a loop through the first press nip, and a second press felt running in a loop through the first press nip, the first press member being situated in the loop of the first press felt and the second press member being situated in the loop of the second press felt, and a second press including a first press member, a second press member, said press members forming a second press nip with each other, a first press felt running in a loop through the second press nip, and a second press clothing running in a loop through the second press nip, the first press member being situated in the loop of the first press felt and the second press member being situated in the loop of the second press clothing.

BACKGROUND OF THE INVENTION

A paper machine of the type described above is known through U.S. Pat. No. 4,483,745. In the first press of the known paper machine, the lower press felt passes around the suction roll for a long distance that is more than twice as long as the actual suction zone. The pressed paper web is transferred to the upper press felt of the second press by means of a suction roll forming a transfer nip with the suction roll of the first press. Suction means cannot therefore be arranged before the transfer of the paper web to the second press to remove water from the lower press felt of the first press downstream of the first press nip. The paper web is therefore rewetted by the wet lower press felt when the paper web and the lower press felt run in intimate contact with each other around the suction roll said long stretch after the suction zone. Furthermore, the known construction lacks steam boxes before the press nip to increase the temperature in the press nip. Neither is it provided with blow boxes to improve running of the paper web.

U.S. Pat. No. 4,561,939 describes a paper machine having a press section consisting of two presses. However, both the first and the second presses lack suction rolls. Suction shoes are used to ensure that the paper web accompanies the desired press felt after the press nip, which makes the construction more expensive. A similar paper machine, having a press without suction press roll, is also described in U.S. Pat. No. 5,389,205.

EP-0 803 605 describes a paper machine with three presses, the middle one of which is located above the other two presses. The first press has a lower shoe press roll and an upper suction press roll around which the upper press felt runs some considerable distance to be deflected more than 90° after the press nip. The suction press roll has a first suction zone situated opposite the press shoe, and a longer suction zone following the first suction zone and extending to the point where the upper press felt and the paper web leave the suction press roll in vertically upward direction.

The upper press felt of the first press also forms the press felt in the first press nip of the middle press. A shoe press with a similar suction press roll and similar large deflection of the web-supporting press felt is described in DE-29701948-U1. In both cases the second press has only one clothing, namely a press felt, but lacks a second clothing, so that the paper web runs a longer distance around one press roll of the second press. A drawback with such configurations as those described in the latter two patent specifications is that the web runs in an open draw from the last press to the drying section and a considerable difference in speed is necessary there in order to remove the web from the smooth roll. This limits the speed of the machine to about 1700–1800 m/min.

Each of the known paper machines constitutes a specific configuration offering very limited opportunity or none at all, for choosing positions for the clothings and press members of the presses, and web run in accordance with the customer's desires and specific machine spaces in each individual case.

SUMMARY OF THE INVENTION

The object of the present invention is to provide an improved paper or board machine designed so that rewetting of the web is avoided, which is free from open draws that limit the speed of the paper or board machine, which offers ample opportunity to apply various types of equipment such as suction boxes, blow boxes and steam boxes at suitable points along the web run, and which allows the positions of the press clothings and press members, as well as web run, to be chosen in accordance with the customer's desires and specific machine spaces in each individual case.

The machine according to the invention is characterized by the combination that the first press member of the first press is a suction roll with a suction zone, within which the first press nip is situated and which has an upstream end and a downstream end, said downstream end being situated downstream and spaced from the first press nip, the second press felt being arranged to be separated from the first press felt at a separation point situated upstream and spaced from the downstream end of the suction zone, that the first press felt of the first press is situated either in a lower or an upper position, and the first press felt of the second press is situated in a reversed relationship in an upper position and lower position, respectively, that the first press felt of the first press is arranged to carry the web from the first press nip to the second press, that the first press member of the second press is a shoe press roll, that the first press felt of the second press is arranged to carry the web from the first press felt of the first press to the second press nip, which is an extended press nip, that a pickup suction roll is arranged in the loop of the first press felt of the second press, close to the first press felt of the first press for transfer of the web from the first press felt of the first press to the first press felt of the second press, that the first press felt of the first press is arranged to leave the suction roll at a point situated at or close to the downstream end of said suction zone, that suction means are arranged in the loop of the first press felt of the first press at at least one point downstream of the suction roll before the transfer of the web to the first press felt of the second press, and that heat-supply means are arranged on the outside of the loops of said press felts situated in an upper position at points where one side of the web is exposed and the other side adheres to said press felts.

BRIEF DESCRIPTION OF THE DRAWINGS

The invention is described in more detail in the following with reference to the drawings.

DETAILED DESCRIPTION OF PREFERRED EMBODIMENTS

Figure 1:
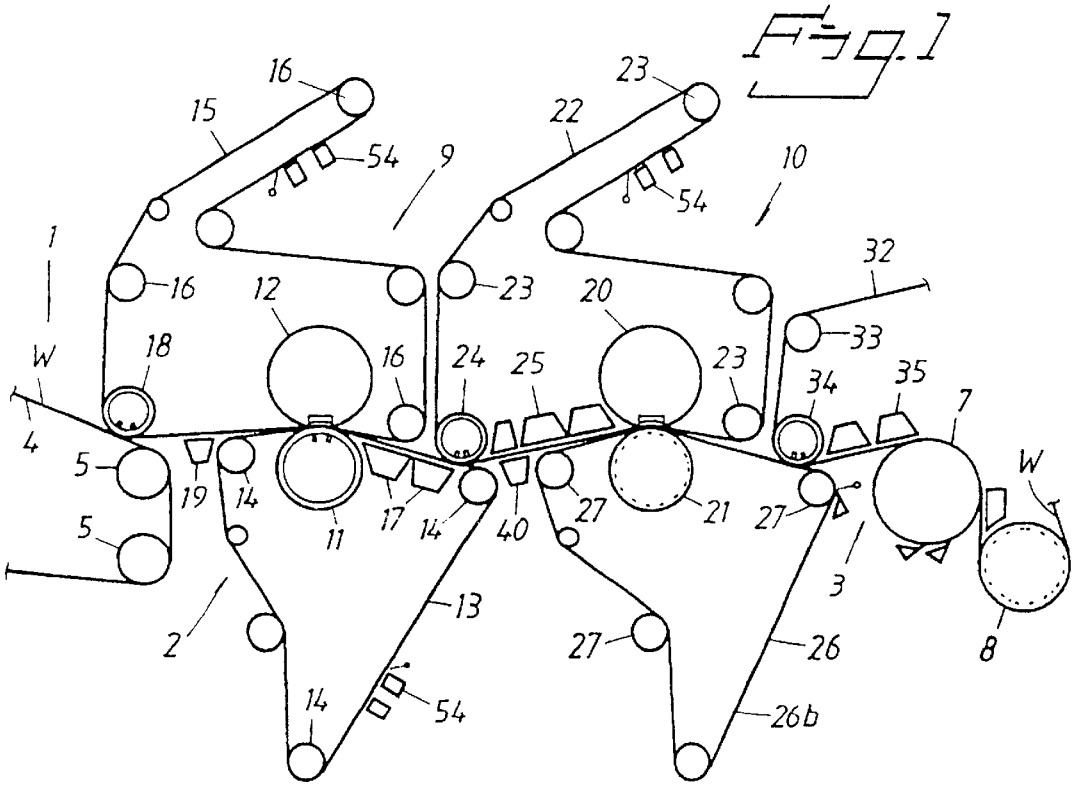
FIG. 1 shows schematically parts of a paper machine according to a first embodiment of the invention.

The invention is described in connection with paper machines but is equally applicable to machines for manufacturing board.

FIGS. 1–4 show schematically parts of paper machines for manufacturing a paper web W. Each of the paper machines comprises a wet section 1, a press section 2 and a drying section 3.

The wet section 1, of which only the downstream part is shown, includes a forming wire 4 which runs in a loop around guide rolls 5. If desired a suction roll (not shown) may be arranged in the loop of the forming wire 4 immediately upstream of a pickup point.

The drying section 3 includes a plurality of drying cylinders 7 and rolls 8 having smooth shells or shells provided with openings or recesses. In the embodiments shown each roll 8 is a suction roll without internal suction box with seals, but with internal vacuum ("VacRoll"). The roll 8 may alternatively consist of an ordinary suction roll with an inner suction box with seals.

The press section 2 includes a first, double-felted press 9 and a second press 10 which may be a single-felted press as shown in FIGS. 1, 3, 5 and 7 or a double-felted press as shown in FIGS. 2, 4, 6 and 8.

The first press 9 includes a first press member 11 and a second press member 12, which press members 11, 12 cooperate with each other to form a first press nip between them. The first press 9 also includes a first endless press felt 13 running in a loop through the first press nip and around a plurality of guide rolls 14. The first press 9 also includes a second endless press felt 15 running in a loop through the first press nip and around a plurality of guide rolls 16.

In all the embodiments according to the present invention the first press member 11 is a suction roll situated in the loop of the first press felt 13, and the first press felt 13 is arranged to carry the web W from the first press nip to the second press 10. Blow boxes generating negative pressure or suction boxes 17 are also provided in the loop of the first press felt 13, these being arranged downstream of the first press nip within the zone where the first press felt 13 carries the paper web W.

The second press member 12 of the first press 9 may be a shoe press roll, as is the case in the embodiments according to FIGS. 1, 2, 5 and 6, or a blind-drilled or grooved roll, as is the case in the embodiments according to FIGS. 3, 4, 7 and 8.

As is clear from the various embodiments, either one of the two press felts 13, 15 may be used as top felt, so that the press felt 13 or 15 of the first press 9, arranged as top felt, also forms pickup felt and is provided in its loop with a pickup suction roll 18 arranged close to the forming wire 4 for transfer of the paper web W from the forming wire 4 to the top felt 13 is (see e.g. FIG. 5) alternatively 15 (see e.g. FIG. 1).

A steam box 19 is arranged close to the outer side of the top felt 13 alternatively 15, downstream of the pickup suction roll 18 for advantageous treatment of the paper web W with steam prior to pressing in the first press nip.

In the embodiments according to FIGS. 1, 2, 3 and 4 the suction roll 11 is in the lower position and the first press felt 13 is therefore a bottom felt which contains in its loop said blow boxes for generating negative pressure or suction boxes 17. In the embodiments according to FIGS. 5, 6, 7 and 8 the suction roll 11 is in upper position and the first press felt 13 is thus a top felt and has said pickup suction roll 18 in its loop, as well as said blow boxes generating negative pressure or suction boxes 17.

According to the present invention the second press 10 is a shoe press including a first press member 20 in the form of a shoe press roll and a second press member 21 in the form of a counter roll, said press members 20, 21 cooperating with each other to form a second, extended press nip. The shoe press 10 also includes a first endless press felt 22 running in a loop through the extended press nip around a plurality of guide rolls 23 and around a pickup suction roll 24 arranged close to the first press felt 13, carrying the web, of the first press 9 so that the first press felt 22 of the shoe press 10 also acts as pickup felt to transfer the paper web W from the web-carrying first press felt 13 of the first press 9 to the first press felt 22 of the shoe press 10. Blow boxes generating negative pressure or suction boxes 25 are also arranged in the loop of the first press felt 22 of the shoe press 10, these being arranged downstream of the pickup suction roll 24 in order to retain the paper web W against the outer side of the first press felt 22 of the shoe press 10 before the extended press nip.

Figure 2:
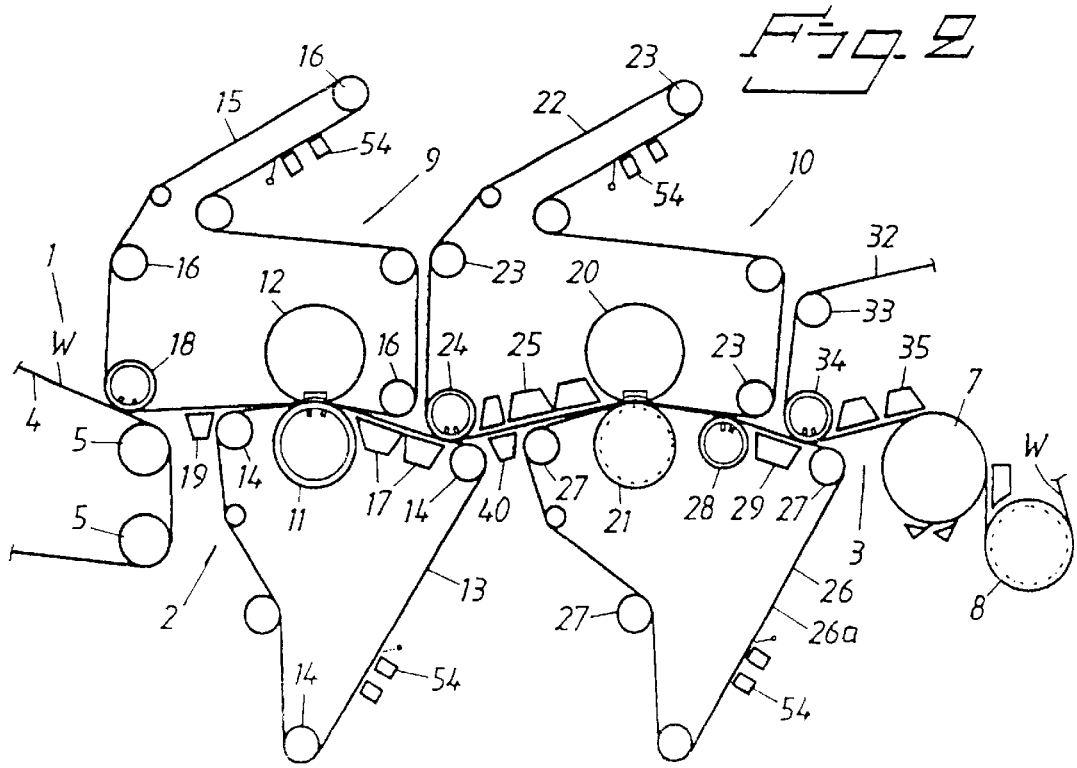
FIG. 2 shows schematically parts of a paper machine according to a second embodiment of the invention.
Figure 3:
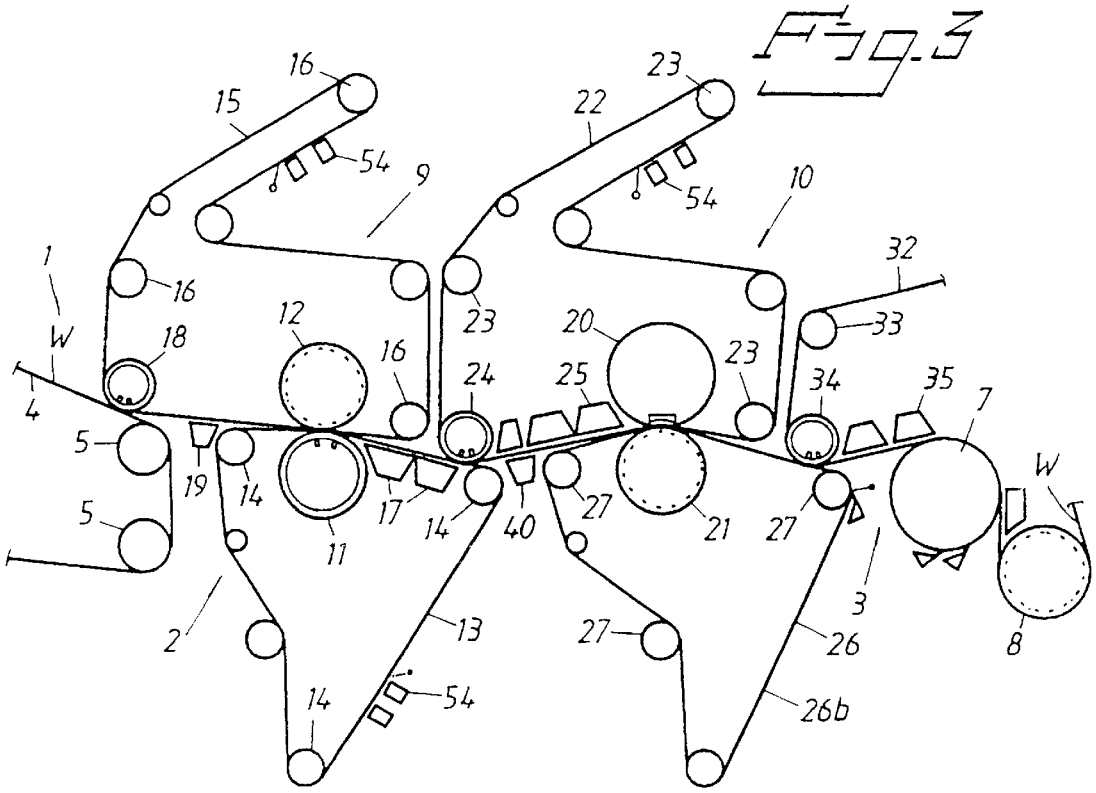
FIG. 3 shows schematically parts of a paper machine according to a third embodiment of the invention.
Figure 4:
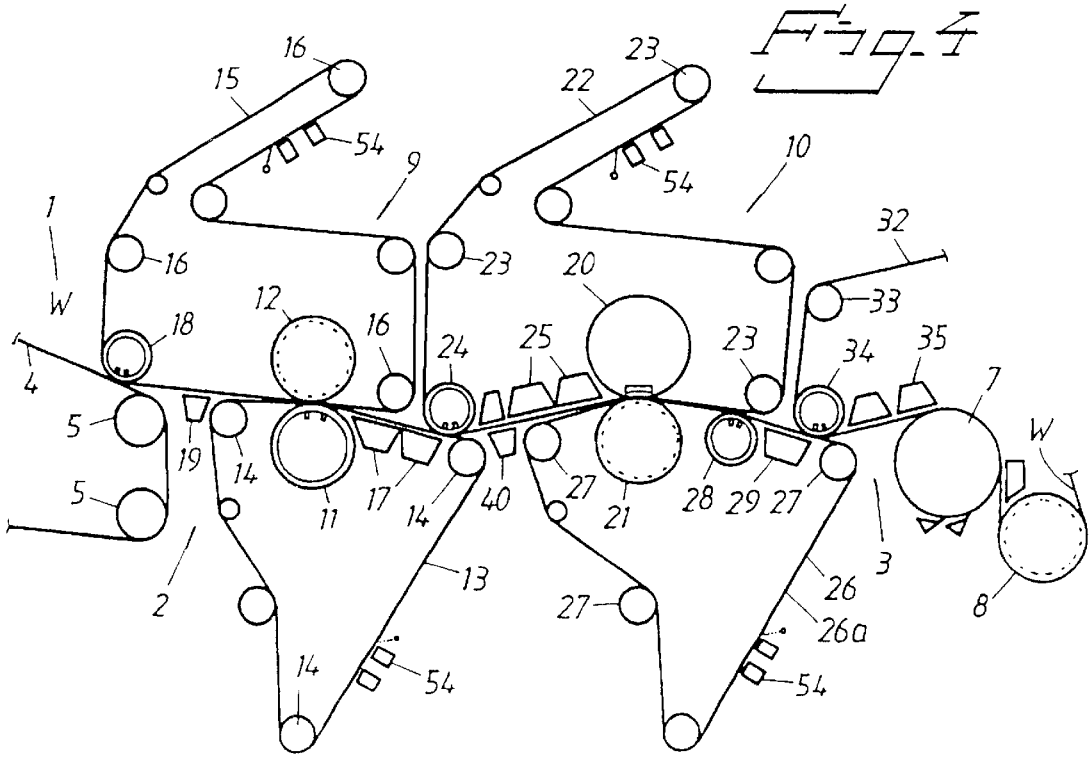
FIG. 4 shows schematically parts of a paper machine according to a fourth embodiment of the invention.

The shoe press 10 also includes a second endless press clothing 26 running in a loop in which the counter roll 21 is situated, through the extended press nip and round a plurality of guide rolls 27. In the embodiments according to FIGS. 2, 4, 6 and 8 the second press clothing 26 is a press felt 26a which, in the embodiments according to FIGS. 2 and 4, is arranged to carry the paper web W from the extended press nip, a suction roll 28 also being arranged in the loop of the press felt 26*a* containing the counter roll 21, the suction roll 28 being located downstream of the extended press nip, followed by a blow box generating negative pressure or suction box 29. In the embodiments according to FIGS. 1, 3, 5 and 7 the second clothing is a transfer belt 26*b* which is impermeable or substantially impermeable and which may have a smooth surface in contact with the web.

In the embodiments illustrated the counter roll 21 of the shoe press 10 is shown as a grooved roll or a blind-drilled roll. The counter roll may alternatively be a smooth roll (not shown).

In the embodiments according to FIGS. 1, 2, 3 and 4 the paper web W is transferred from the bottom felt 13 of the first press 9 to the top felt 22 of the shoe press 10, whereas in the embodiments according to FIGS. 5, 6, 7 and 8 the paper web W is transferred from the top felt 15 of the first press 9 to the bottom felt 26*a* of the shoe press 10. In the embodiments according to FIGS. 6 and 8 the bottom felt 26*a* of the shoe press 10 is also arranged to carry the paper web W after the extended press nip up to the drying section. In this case the loop of the bottom felt 22 which contains the shoe press roll 20 is also arranged to contain a suction roll 30 downstream of the extended press nip, followed by a blow box generating negative pressure or suction box 31.

Figure 5:
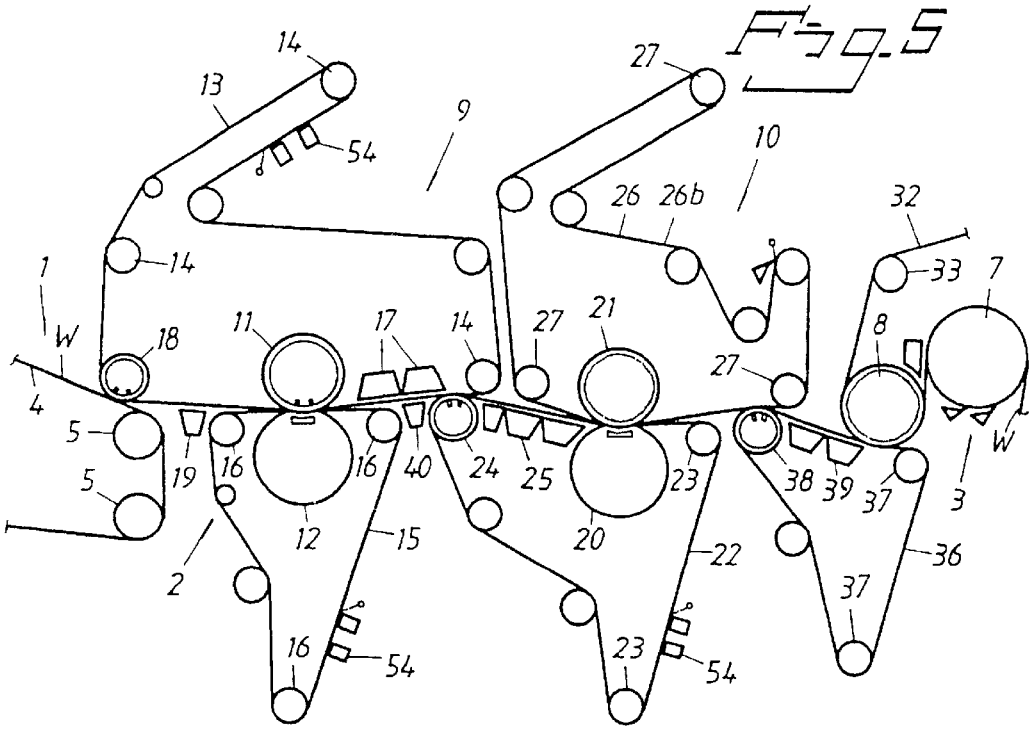
FIG. 5 shows schematically parts of a paper machine according to a fifth embodiment of the invention.

As can be seen from the various embodiments, the position of the first press felt 22 of the second shoe press 10 is determined by the position of the first press felt 13 of the first press 9, the loop of the press felt 13 holding the suction roll 11, so that the positions are always inverted, i.e. if the first press felt 13 of the first press 9 containing the suction roll 11 in its loop is in the lower position as in FIG. 1, for instance, then the first press felt 22 of the second shoe press 10 is always in the upper position, and vice versa, as in FIG. 5, for instance.

The drying section 3 includes an endless, permeable drying clothing 32 in the form of a drying wire or drying felt running in a loop around a plurality of guide rolls 33, drying cylinders 7 and rolls 8 which may be grooved rolls or blind-drilled rolls as shown, or alternatively, smooth rolls. In the embodiments according to FIGS. 1, 2, 3, 4, 6 and 8 the drying wire or felt 32 also runs around a pickup suction roll 34 arranged close to the bottom clothing 22, or alternatively 26*a* or 26*b*, of the shoe press 10 so that the pressed paper web W is transferred from the bottom clothing 22, or alternatively 26*a* or 26*b*, to the drying wire or drying felt 32. Blow boxes generating negative pressure or suction boxes 35 are arranged at suitable points in the loop of the drying wire or felt 32. A separate, endless pickup clothing 36 is used in the embodiments according to FIGS. 5 and 7, which may be a wire or a felt running in a loop around a plurality of guide rolls 37 and a pickup suction roll 38 arranged close to the top clothing of the shoe press 10, i.e. the transfer belt 26*b*, for transfer of the pressed paper web W from the transfer belt 26*b* to the pickup clothing 36. A blow box generating negative pressure or suction box 39 is arranged downstream of the pickup suction roll 38 in the loop of the pickup wire or felt 36. The roll 8 of the drying section situated upstream is arranged close to the pickup wire or felt 36 so that the pressed paper web W is transferred from the pickup wire or felt 36 to the drying wire or felt 32.

A steam box 40 is arranged in a free space existing between the bottom felt of the first press 9 and the bottom clothing of the second shoe press 10, close to either the top felt of the first press 9 as shown in FIG. 5, for instance, or to the top clothing of the second shoe press as shown in FIG. 1, for instance, where the lower side of the paper web is exposed.

Figure 9:
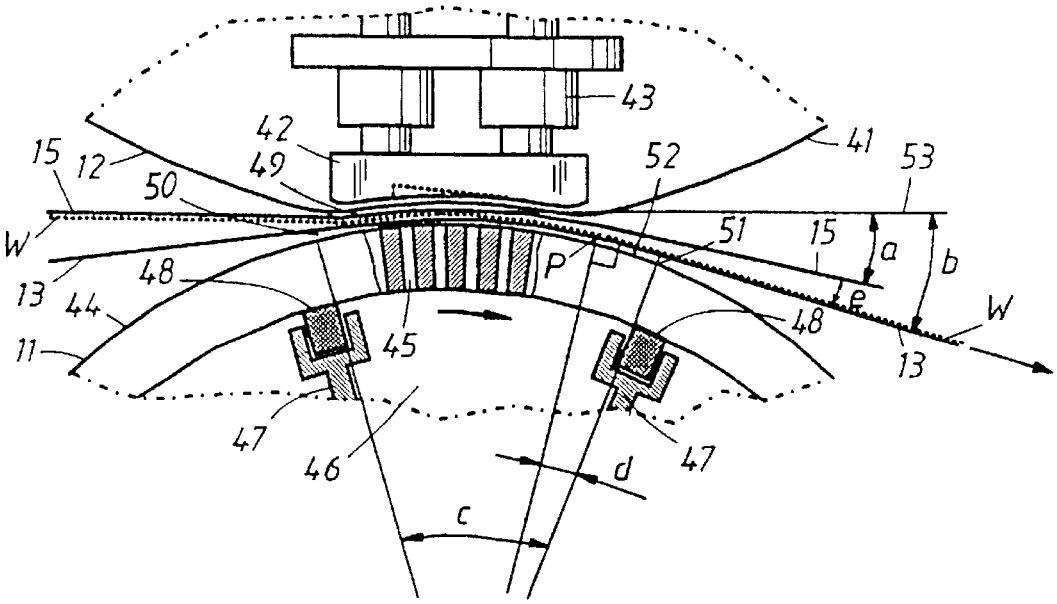
FIG. 9 is an enlarged view of a shoe press of the paper machine according to FIG. 1 or FIG. 2.

FIG. 9 shows parts of the shoe press 10 included in the embodiments according to FIGS. 1–4. The shoe press roll 12 has a flexible shell 41 and a press shoe 42 which has a concave surface over which the flexible shell 41 runs and which is substantially concentric with the suction roll 11. The pressure of the shoe press against the suction roll 11 is regulated by jack devices 43 extending in two rows transversely to the machine direction. The suction roll 11 has a form stable shell 44 provided with radial suction apertures 45, and an inner vacuum chamber 46 defined by walls 47 extending transversely to the machine direction and having sealing bodies 48 at their upper ends, these bodies being in sliding, sealing contact with the cylindrical inner side of the shell 44. The two sealing bodies 48 define a suction zone 49 between them, which acts on the outer side of the shell 44 and encompasses a sector angle c which is in the range of 10°–30°. A press shoe 42 is situated within this suction zone 49. The suction zone 49 has an upstream end 50 and a downstream end 51, which upstream and downstream ends 50, 51 extend across the machine direction. The two press felts 13, 15 run together upstream of the extended press nip at the upstream end 50 of the suction zone 49, enclosing the paper web W between them. Downstream of the extended press nip the top felt 15 leaves the bottom felt 13 and the suction zone 49 at a separation point P. This separation point P and the downstream end 51 of the C suction zone 49 between them define a downstream area 52 of the suction zone 49 which encompasses a sector angle d which is in the range of 0°–10°, preferably 1°–7°. After the separation point P the top felt 15 forms an angle a with the horizontal line 53 which is in the range of 0°–20°, preferably 5°–13°. The bottom felt 13 continues to run in contact with the shell 44 of the suction roll 11 in said downstream area 52 of the suction zone 49, thus ensuring that the paper web W adheres firmly to the bottom felt 13 and is carried by this. The bottom felt 13, and thus the paper web W, leaves the suction roll 11 at or close to the downstream end 51 of the suction zone 49 forming an angle b to the horizontal line 53 which is in the range of 5°–30°, preferably 8°–20°. It will be understood that the angle b is always greater than the angle a in each individual case. This difference is preferably at least 5°, i.e. $b-a \geqq 5°$, taking into account said angle areas for a and b. It will also be understood that the angle c is always greater than the angle d in each individual case. This difference is preferably at least 5°, i.e. $c-d \geqq 5°$, taking into account said angle areas for c and d. When the bottom felt 13 leaves the suction roll 11 exactly at the downstream end 51 of the suction zone, the angle b–c will be equal to the angle d.

Figure 6:
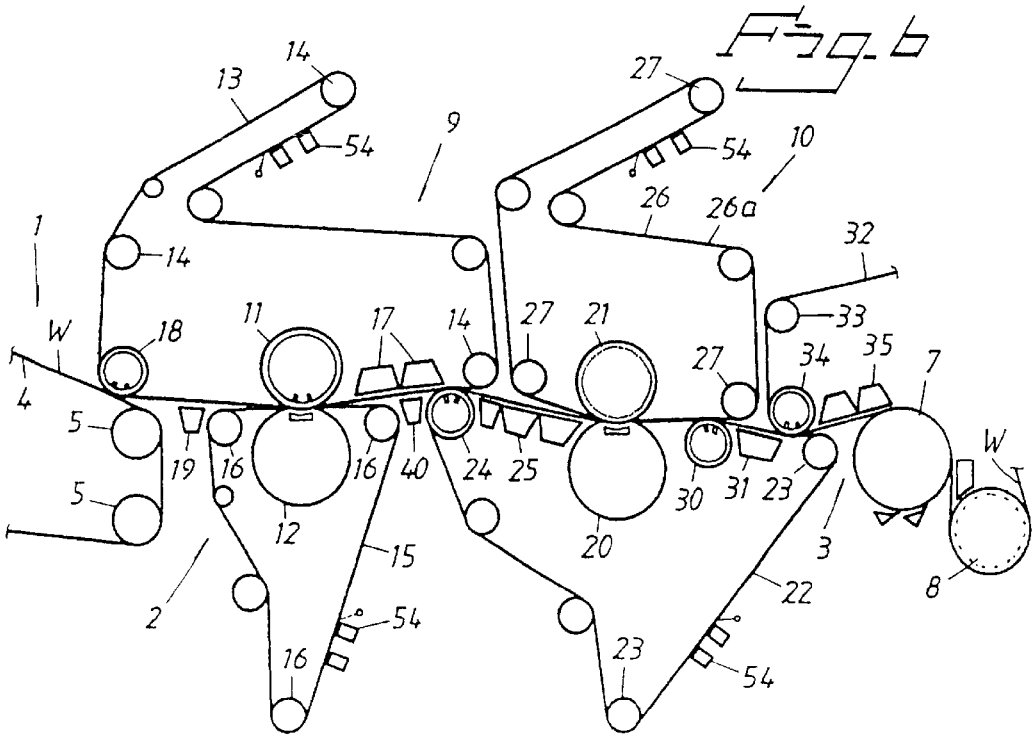
FIG. 6 shows schematically parts of a paper machine according to a sixth embodiment of the invention.
Figure 7:
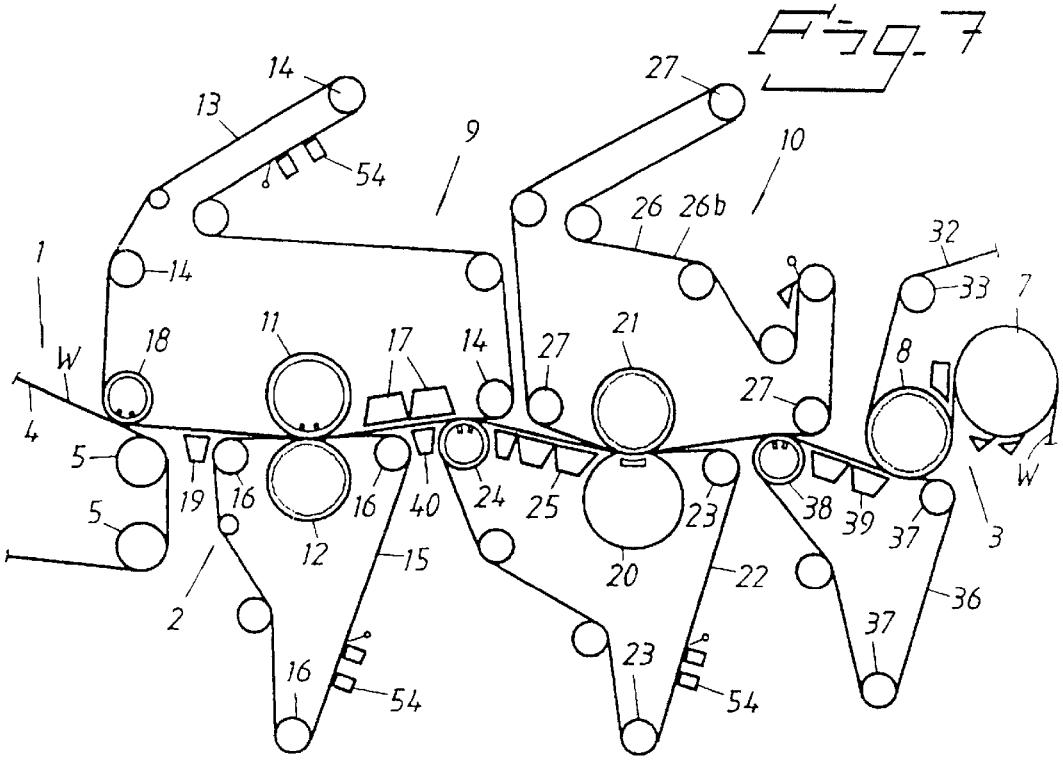
FIG. 7 shows schematically parts of a paper machine according to a seventh embodiment of the invention.
Figure 8:
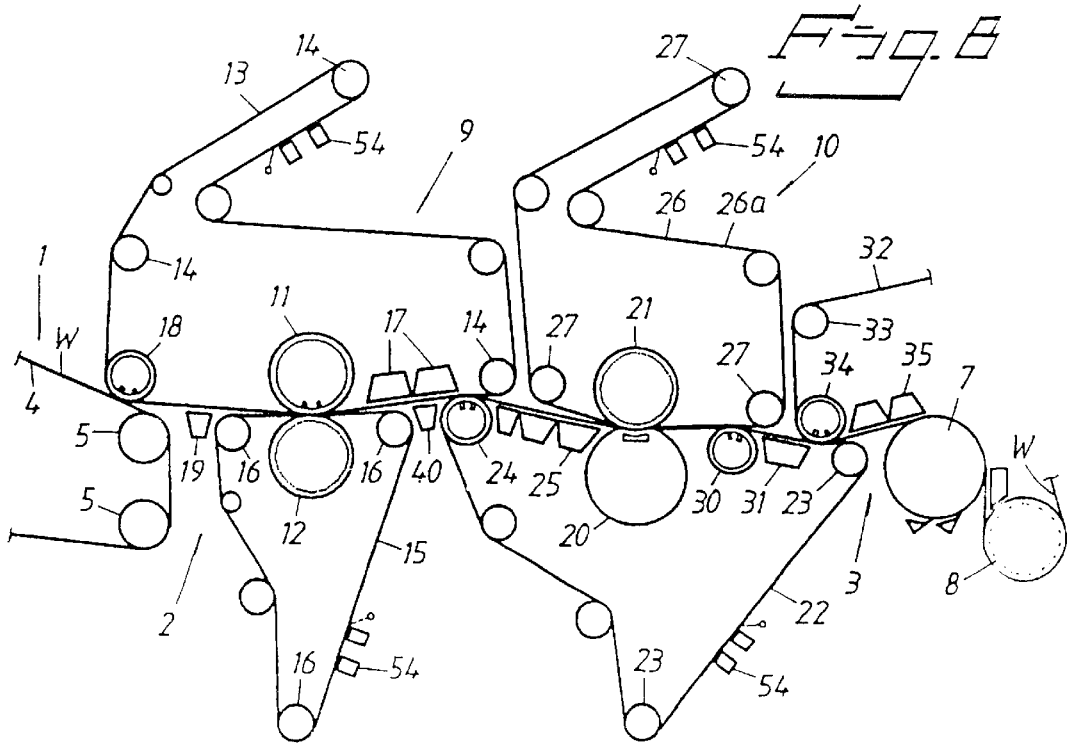
FIG. 8 shows schematically parts of a paper machine according to an eighth embodiment of the invention.
Figure 10:
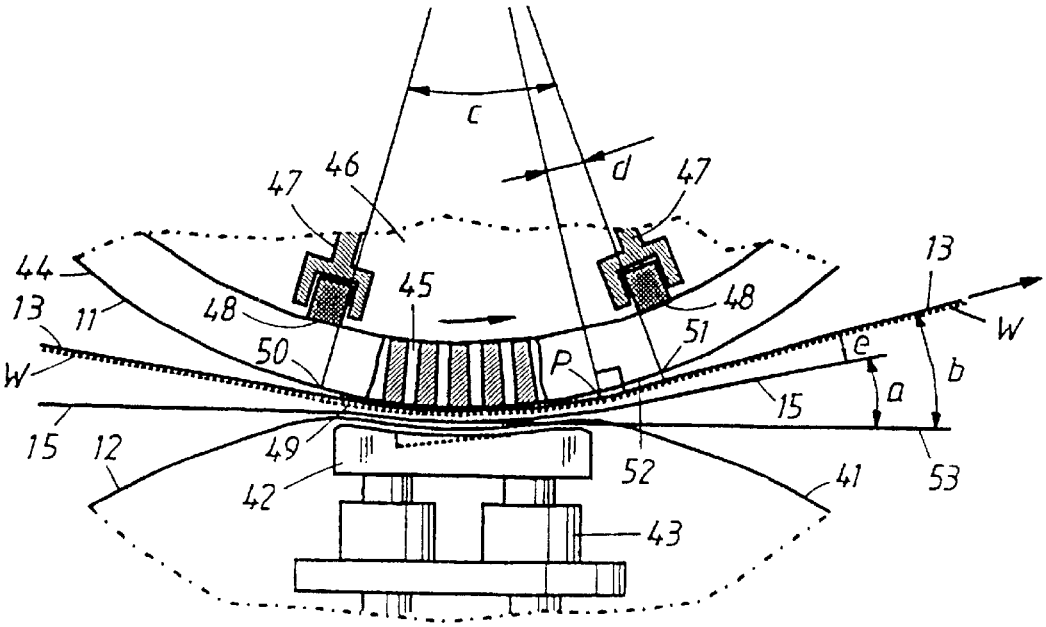
FIG. 10 is an enlarged view of a shoe press of the paper machine according to FIG. 5 or FIG. 6.

FIG. 10 shows parts of the shoe press included in the embodiments according to FIGS. 5 and 6 and having the shoe press roll in the lower position instead. It can therefore be described in the same way as above, except that the reference numbers for the top and bottom felts are changed.

The suction roll 11 of the first press 9 may have an ordinary stainless steel shell or a shell made of metal powder in order to obtain high strength, which shell is suitable for a shoe press 9 operating under high load. The suction roll 11 of the first press 9 may also have a clothing, i.e. a rubber or polyurethane clothing, with suction apertures or suction apertures and blind-drilled holes or grooves. Masking of the suction roll can thus be avoided.

The reference number 54 denotes suitable equipment for conditioning the press felts 13, 15, 22, 26*a*.

As is clear from the drawings, the press section has closed web run from the wet section to the drying section, thus allowing good running for all grades of paper and board as well as high running speed for paper with low weight. The press section has two optimized press nips to achieve good running and dry solids content. The first nip is a roll nip with a suction roll as press roll. The suction roll and blow boxes after the first nip result in good running and the risk of rewetting the web is reduced to a minimum after the first press nip. The second press nip is a shoe nip where extremely high nip load can be used and extremely high dry solids content can be obtained. Better dry solids content can be achieved and the dry solids content profile can be regulated by using a steam box before the first press nip, and especially after the second press nip.

I claim:

1. A machine for manufacturing a continuous web of paper or board, comprising:

a wet section in which a wet paper web is formed;

a drying section in which the paper web is dried; and a press section between the wet section and drying section for pressing and dewatering the wet paper web, the press section comprising first and second presses wherein:

the first press includes first and second press members forming a first nip therebetween and first and second press felts respectively arranged in two endless loops within which the first and second press members are respectively disposed such that the first and second press felts pass through the first nip, one of the first and second press felts being arranged to receive the web coming from the wet section and carry the web through the first nip with the web enclosed between the first and second press felts, the first press member comprising a suction roll having a suction zone that includes the first nip, the first press further comprising at least one suction-producing device disposed downstream of the suction roll within the loop of the first press felt, and the first press felt carrying the web from the first nip to the second press;

the second press includes first and second press members forming a second nip therebetween, a first press felt arranged in an endless loop within which the first press member of the second press is disposed such that the first press felt passes through the second nip, and a second press clothing arranged in an endless loop within which the second press member of the second press is disposed such that the second press clothing passes through the second nip, the first press felt of the second press being arranged to receive the web from the first press at a pickup point and carry the web through the second nip, the second press further including at least one suction-producing device spaced downstream of said pickup point and upstream of the second nip within the loop of the first press felt; and the first press felt of one of the presses is situated in an upper position and the first press felt of the other press is situated in a lower position with respect to the paper web.

2. The machine of claim 1, wherein the suction zone of the suction roll of the first press has a downstream end spaced downstream of the first nip, and the second press felt is arranged to separate from the first press felt of the first press at a separation point spaced upstream of the downstream end of said suction zone.

3. The machine of claim 2, wherein the first press member of the second press comprises a shoe press roll such that the second nip is an extended nip.

4. The machine of claim 3, wherein the second press further includes a pickup suction roll arranged in the loop of the first press felt of the second press, the pickup suction roll being located proximate the first press felt of the first press for transfer of the web from the first press felt of the first press onto the first press felt of the second press.

5. The machine of claim 4, wherein the first press felt of the first press is arranged to depart from the suction roll of the first press at a point located proximate the downstream end of the suction zone.

6. The machine of claim 5, further comprising a heating device arranged outside the loop of one of the press felts that is situated in an upper position with respect to the paper web, the heating device being disposed at a location at which one side of the web is adhered to an under surface of said press felt and an opposite side of the web is exposed.

7. The machine of claim 6, wherein the heating device is located in the first press upstream of the first nip.

8. The machine of claim 7, wherein the first press felt of the second press is situated in an upper position with respect to the paper web, and further comprising a second heating device arranged outside the loop of the first press felt of the second press at a location at which one side of the web is adhered to an under surface of the first press felt and the opposite side of the web is exposed.

9. The machine of claim 8, wherein the second heating device is located upstream of the second nip.

10. The machine of claim 7, wherein the first press felt of the first press is situated in an upper position with respect to the paper web such that the heating device is arranged outside the loop of the first press felt upstream of the first nip, and further comprising an additional heating device arranged outside the loop of the first press felt downstream of the first nip at a location at which one side of the web is adhered to the under surface of the first press felt and the opposite side of the web is exposed.

11. The machine of claim 1, wherein the second press member of the first press is a shoe press roll having a press shoe located within the suction zone of the suction roll.

12. The machine of claim 1, wherein the second press member of the first press comprises one of a smooth press roll, grooved press roll, and blind-drilled press roll.

13. The machine of claim 1, wherein the suction zone encompasses a sector angle c of the suction roll of about 10°–30° and has a downstream end that is spaced downstream of the first nip, wherein the first press felt is arranged to separate from the second press felt at a separation point spaced upstream from the downstream end of the suction zone, and wherein the suction zone has a downstream area that is downstream of the separation point and encompasses a sector angle d of the suction roll of about 0°–10°, the angle c being greater than the angle d.

14. The machine of claim 13, wherein the first press felt of the first press is arranged to leave the suction roll at an angle b to a horizontal plane of about 5°–30°, and the second press felt of the first press is arranged to leave the suction roll at an angle a to the horizontal plane of about 0°–20°, the angle b being greater than the angle a.

15. The machine of claim 14, wherein an angle e between the first and second press felts leaving the suction roll is substantially equal to the sector angle d.

16. The machine of claim 1, further comprising a heating device arranged outside the loop of one of the press felts that is situated in an upper position with respect to the paper web, the heating device being disposed at a location at which one side of the web is adhered to an under surface of said press felt and an opposite side of the web is exposed.

17. The machine of claim 16, wherein the heating device is located in the first press upstream of the first nip.

18. The machine of claim 17, wherein the first press felt of the second press is situated in an upper position with respect to the paper web, and further comprising a second heating device arranged outside the loop of the first press felt of the second press at a location at which one side of the web is adhered to an under surface of the first press felt and the opposite side of the web is exposed.

19. The machine of claim 18, wherein the second heating device is located upstream of the second nip.

20. The machine of claim 1, wherein the suction roll of the first press has a shell made of metal powder.

* * * * *

UNITED STATES PATENT AND TRADEMARK OFFICE

CERTIFICATE OF CORRECTION

PATENT NO. : 6,656,325 B1
DATED : December 2, 2003
INVENTOR(S) : Laapotti

It is certified that error appears in the above-identified patent and that said Letters Patent is hereby corrected as shown below:

Title page,
Item [63], Related U.S. Application Data, "May 17, 1999" should read
-- May 7, 1999 --;
Insert -- [30] Foreign Application Priority Data
May 15, 1998 (SE) 9801741-1 --.

Column 1,
Line 3, after the title, insert the sub-heading:
-- CROSS-REFERENCE TO RELATED APPLICATIONS --;
Line 8, after the first paragraph, insert the sub-heading:
-- FIELD OF THE INVENTION --.

Signed and Sealed this

Twenty-seventh Day of April, 2004

JON W. DUDAS
*Acting Director of the United States Patent and Trademark Office*